United States Patent [19]

Kossor

[11] Patent Number: 4,615,575

[45] Date of Patent: Oct. 7, 1986

[54] MODULAR CONNECTOR FOR SECURING TELEPHONE LINE

[76] Inventor: Michael G. Kossor, 317 W. First Ave., Roselle, N.J. 07203

[21] Appl. No.: 728,088

[22] Filed: Apr. 29, 1985

[51] Int. Cl.[4] ..... H01R 13/633

[52] U.S. Cl. ..... 339/82; 29/868; 29/764; 339/91 R

[58] Field of Search ..... 339/91 R, 217 S, 82; 29/764, 868; 81/488

[56] References Cited

U.S. PATENT DOCUMENTS

| | | | |
|---|---|---|---|
| 3,617,982 | 11/1971 | Hardesty | 339/91 R |
| 3,866,997 | 2/1975 | Kreutter et al. | 339/217 S |
| 3,880,487 | 4/1975 | Goodman et al. | 339/91 R |
| 4,113,179 | 9/1978 | McKee | 339/91 R |
| 4,379,609 | 4/1983 | Hardesty | 339/91 R |

*Primary Examiner*—John McQuade

*Attorney, Agent, or Firm*—Martha G. Pugh

[57] ABSTRACT

A security modular connector constructed to fit into a conventional jack or receptacle for use in securing a connection in a telephone or computer system, such as for connecting a telephone base unit to a telephone line. The security modular connector differs from a conventional modular connector in that the spring-biased tab which bears on a stop when in electrically-engaged relation with the jack or receptacle is cut off so that it does not protrude through the opening of the latter, thereby denying manual access to the tab. Furthermore, a flange on the outer end of the security modular connector substantially closes the opening in the jack or receptacle when the connector is in engagement with the former. Thus, unauthorized persons are denyed access to the line. A special tool enables authorized persons to pry open the security modular connector from the face of the jack or receptacle, and depress the spring-biased tab, releasing the security connector from the jack or receptacle.

7 Claims, 7 Drawing Figures

MODULAR CONNECTOR FOR SECURING TELEPHONE LINE

BACKGROUND OF THE INVENTION

This relates in general to modular connectors for securing telephone lines, telephone units or computer systems, and more particularly, in the embodiment under description, to modular connectors of a type which is constructed to prevent the terminal leading from the base telephone instrument from being disconnected from the jack or receptacle leading to the telephone line by unauthorized persons.

In accordance with present day practice, many base telephone instruments are connected to the line by means of conventional modular connectors which are constructed to be manually plugged into or removed from a wall jack which is positioned at a convenient place on the premises. Whereas such a practice adds to the convenience of the user, it has certain drawbacks, in that any unauthorized person is free to disconnect and remove the base telephone from the line, thus making useless any security devices adapted to limit access to a proprietary telephone line by unauthorized persons. The same disadvantage is true of conventional modular connectors and jacks used in other parts of the telephone system or of similar types of modular connectors and jacks used in computer systems.

Accordingly, it is the principal object of the invention to provide increased security for proprietary telephone or computer lines from use by unauthorized persons. A more particular object of the invention is to prevent unauthorized persons from removing a telephone instrument from the telephone line by manually disconnecting the connector from the jack. Another object of the invention is to provide a module for connecting the telephone instrument to the telephone line which cannot be removed manually from the telephone jack by unauthorized persons, but which can be readily removed manually from the telephone jack by unauthorized persons, but which can be readily removed by authorized persons having the proper tool.

SHORT DESCRIPTION OF THE INVENTION

These and other objects of the invention are realized in a special modular connector or terminal on the line leading from the telephone instrument, which is constructed to fit into and engage a conventional telephone jack leading to the telephone line, or to similar types of modular connectors used in other parts of telephone or computer systems. The conventional telephone system, the connection between the telephone jack and the telephone line, the terminal or connector comprises a solid body portion, constructed to fit into the jack, which has on its upper surface a spring-biased tab which is depressed by the user to enable the body portion to enter an opening in the receptacle or jack. When the pressure on the tab is released, after the terminal has entered the receptacle, the tab moves upward, engaging an internal shoulder in the opening, preventing removal, unless the tail of the tab, which projects out from the interface between the connector and the jack, is again depressed manually. Thus, anyone having manual access to the projecting tail of the tab can depress it, and remove the terminal from the jack.

In accordance with the present invention, in the embodiment under description, which relates to a connection between the base telephone unit and the telephone line, a special connector is provided in which the tail of the spring-biased tab is cut off, so that when the body of the terminal is interposed into the jack, the tab rests on an internal shoulder of the jack and does not extend out from the interface between the jack and the special connector. The special connector is further provided with a vertically-extending flange on its rear face, which is disposed in close proximity to the front face of the jack, substantially closing the opening to a very small clearance, so that one attempting to manually disengage the connector from the jack has no access.

Access may be obtained, in accordance with the present invention, by authorized persons having a special tool. The latter is grasped by a handle, and is equipped with an axial stem terminating in a flanged portion, bent through, say, 90 degrees from the axis of the stem, and beveled on its protruding edge. This tool serves to disengage the vertically-extending flange of the connector from the face of the jack, thereby gaining access for the tool to enter into the opening in the jack, and depress the tab, releasing engagement with the inner shoulder of the jack opening. Thus, the connector may be readily removed. It will be understood that the same principles can be applied to modular type connectors used in other parts of the telephone system, or in computer systems.

Other objects, features, and advantages of the invention will be apparent to those skilled in the art from a study of the attached drawings and detailed description hereinafter.

SHORT DESCRIPTION OF THE DRAWINGS

DETAILED DESCRIPTION OF THE INVENTION

Figure 1:
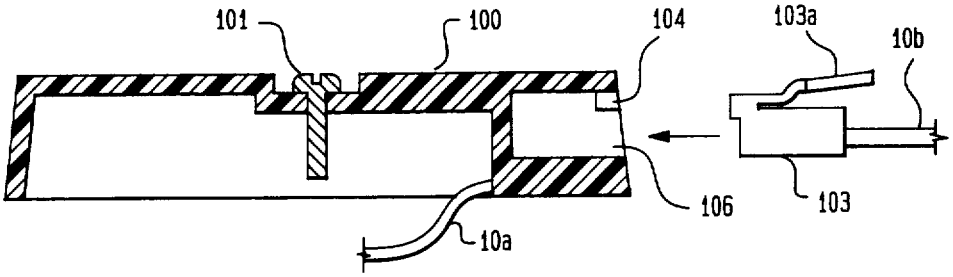
FIG. 1 (PRIOR ART)
FIG. 1 is a showing, in longitudinal section. for the pruposes of illustration, of a standard modular telephone receptacle and standard male modular connector.

Referring in detail to the drawings, FIG. 1 illustrates in longitudinal section the standard female modular jack or receptacle 100 used in the prior art for connecting a base telephone to the telephone line in a conventional telephone system. The opening 106 of modular jack or receptacle 100 includes on its internal bottom surface the bare connecting wires of the terminal portion of the telephone line 10*a*, which are disposed to mate with the terminal wires of the line 10*b*, when the jack or receptacle and modular male plug are in closed conducting relation. Jack or receptacle 100 is constructed to receive in its opening 106, the standard male plug 103 connected to line 10*b*, which plug includes the spring-biased tab 103*a* on its upper surface, a shoulder of which is locked against one or more internally-depending stops 104 when plug 103 is in place in opening 106. The standard removal procedure requires tab 103*a* to be depressed to release its shoulder from contact with stop 104, while exerting a force on the attached telephone line 10*b*, away from the receptacle 100. Access to the telephone line could now be made using a telephone set incorporating modular connections.

Figure 2:
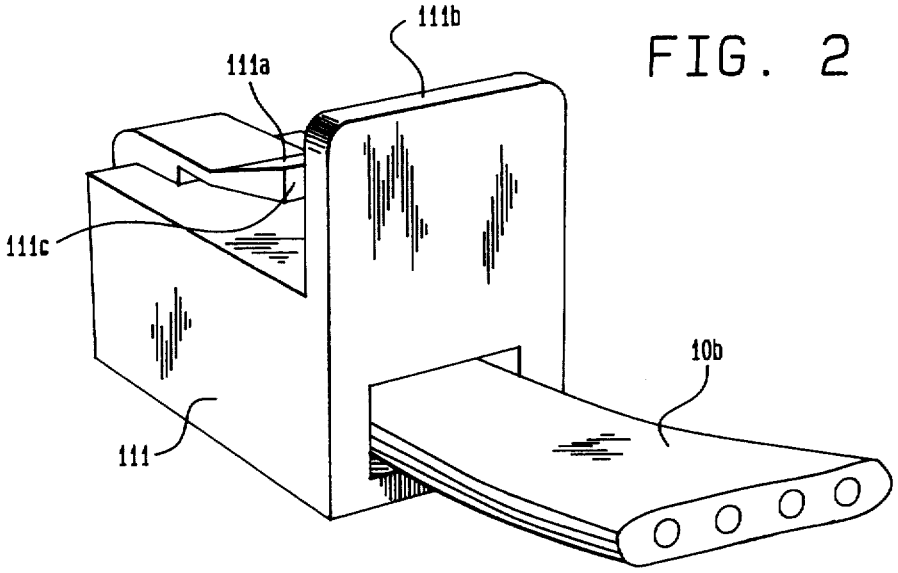
FIG. 2 is an enlarged perspective showing of a special modular connector for incorporation into the telephone system of the present invention, for protecting the connection to the telephone network.

When a higher degree of security is desired, the line leading from the telephone circuit preferably incorporates the special modular connector 111, shown in FIG. 2, which is substituted for connector 103, for the purpose of connecting the telephone line to the telephone network. FIG. 2 illustrates the modified connector 111. In accordance with the present invention the elongated tab 103*a* has been cut off, leaving only the securing shoulder 111*a* which in its normally-closed condition engages one or more stops 104 in the opening 106 in the standard female telephone line receptacle 100.

The modified male plug 111, which in the present invention comprises a plastic block about ½ inch long, ⅜ inch wide, and ¼ inch thick, has the terminal portion of telephone line 10*b* embedded in the block longitudinally, so that its individual wires present their bare connecting surfaces flush with the bottom surface of the block adjacent its inner end, in accordance with standard telephone practice. Securing tab 111*a* is fastened to the upper surface of block 111, so that its open end projects over the surface of block 111 in cantilever fashion, terminating at about the center of the block in a shoulder 111*c*, which in normal connected relation with opening 106 of receptacle 100 engages its shoulder 104.

The outer end of block 111 terminates in a vertically-extending flange or shield 111*b* which, when block 111 is engaged in opening 106 in secured relation, rests in close proximity to the outer end face of receptacle 100, closing access to the opening 106 except for a clearance not exceeding, say, 0.06 inch, in the present embodiment, making it impossible to manually depress and disengage the tab 111*a*.

Connection is thereby provided between the line from the telephone network 10*b* and the telephone line 10*a*. Thus, the telephone circuit is now constructed to operate in conjunction with a standard modular telephone receptacle for the purpose of communication with the telephone Base Unit. The feature of being modular has not been lost; however, the modular connector available in accordance with the present invention provides controlled access to the line.

Figure 3:
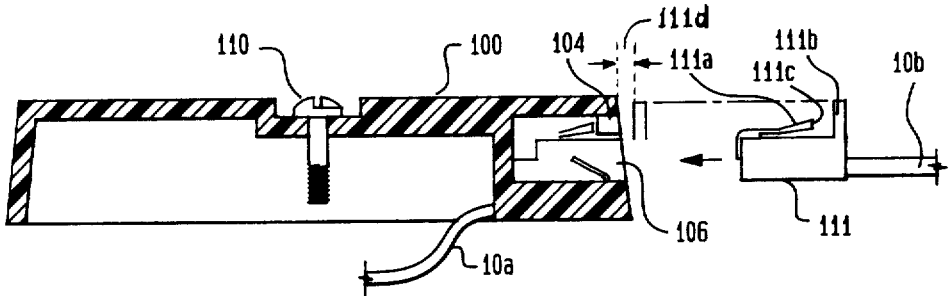
FIG. 3 is a longitudinal sectional showing of the special modular connector of FIG. 2 being assembled with a conventional jack.

If security is to be increased still further, the standard securing screw 101, shown in FIG. 1, can be replaced by one of the "tighten only" types as shown by 110 in FIG. 3. The screw head has been designed to allow a screwdriver to apply torque in one direction only. Thus, by incorporating special modulator connector 111 and special one-way screw 110, the only way to gain access to the telephone line 10*a* is to cut the telephone line itself.

It should be noted that the proposed method of added security just described is adapted to eliminate the loss of security of telephone systems which incorporate security units of the type disclosed in my copending application Ser. No. 718,565, filed Apr. 1, 1985, and also in systems incorporating mechanical dial locks of a type well known in the art.

Figure 4B:
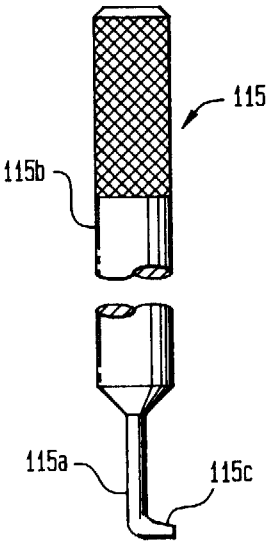
FIG. 4B shows the tool of FIG. 4A rotated 90 degrees about its longitudinal axis.
Figure 4A:
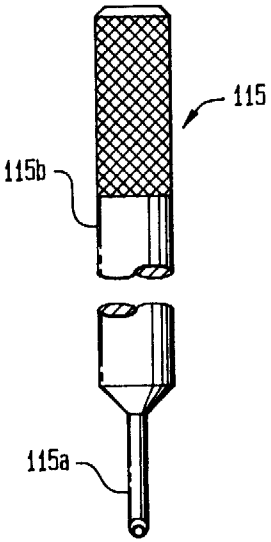
FIG. 4A shows a special tool constructed to disengage the special modular connector of FIG. 2 from the conventional jack.

Assuming one wishes to remove the special modular connector 111, a removal tool such as the tool 115, depicted in FIGS. 4A, 4B, could be fabricated. Tool 115, in the present example, is 7¼ inches long. The shank portion 115*a* is 0.04 inch in diameter, and 0.3 inch long, the lower end 115*c* being curved through a right angle to provide a flange which extends 0.12 inch in a lateral direction, being slightly tapered and flattened at the end, so as to have a thickness in the direction of the principal axis of the shaft 115*a* which does not exceed the clearance 111*d*. The handle 115*b*, which may vary in size, extends, say, 5½ inches in an axial direction from the upper end of shank 115*a*. Handle 115*b* may be cerrated, or otherwise treated to provide a grip.

Figure 5A:
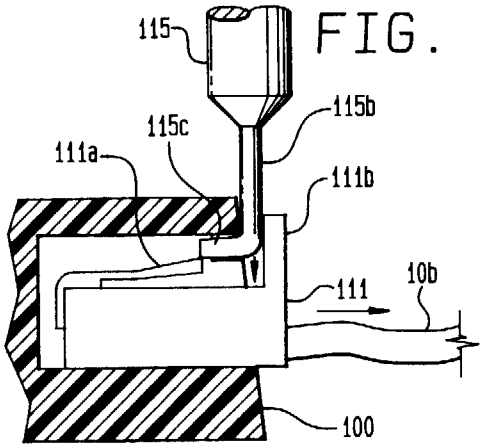
FIGS. 5A and 5B are sectional showings of the tool of FIGS. 4A, 4B, operating to disengage the modular connector of FIG. 2 from the jack.
Figure 5B:
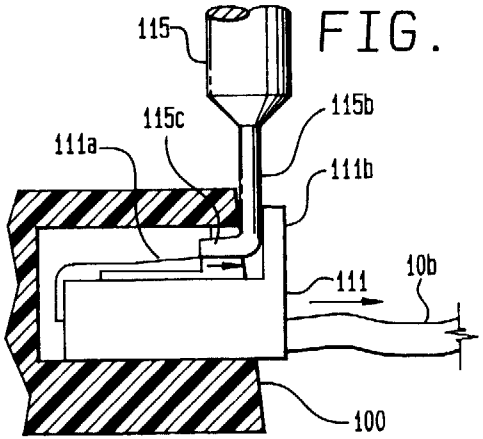

Application of the tool 115 is shown in FIGS. 5A, 5B. Assuming modular jack 111 is in place, in secured relation to receptacle 100, the end flange 115*c* is inserted into the clearance 111*d* between the face of opening 106 and the flange or shield 111*b*, so that flange 115*c* is parallel with the flange or shield 111*b*. Once in place, the "L" shaped end 115*c* is turned 90 degrees until it is positioned directly over the security tab 111*a*; then the connector 111 can be removed by applying a downward force on the tool 115 as it depresses tab 111*a*, while simultaneously applying an extracting force on the modular connector 111.

It will be understood that the principles of this invention are not limited to the specific examples given herein by way of illustration, but are applicable to modular-type connectors used, together with jacks or receptacles in other parts of the telephone system, or to similar types of connectors used in computer systems.

What is claimed is:

1. A modular connector for preventing unauthorized access to a standard jack or receptacle connected to a first telephone or computer line, wherein said jack or receptacle has a flat outer face with a substantially rectangular opening constructed to accommodate said modular connector in snug electrically-engaged relation, and said substantially rectangular opening has an internal stop projecting from an inner wall thereof and bare contacting wires on its internal lower surface;

said modular connector having a solid body portion which is constructed to expose on its lower surface the bare contacting portion of a terminal of a second line in said telephone or computer system, a spring-biased tab disposed in cantilever fashion on the upper surface of said solid body portion, said tab having a shoudler constructed, when said modular connector is in snug electrically-engaged relation with the opening of said jack or receptacle, so that the bar contacting wires on the inner lower surface of said jack or receptacle engage the terminal contacting portion of said second line, to bear against said internal stop, said tab having no portion which protrudes beyond the face of said opening when said modular connector is in said snug electrically-engaged relation with said jack or receptacle, thereby preventing manual removal of said modular connector from said jack or receptacle, wherein the outer end of said modular connector comprises a flange extended in a plane substantially normal to the principal axis of said modular connector, constructed to form a clearance with the inner surface of said flange in substantially parallel to close proximity to the flat outer face of said jack or receptacle surrounding said opening, when said modular connector is in snug electrically-engaged relation with said jack or receptacle.

2. The combination in accordance with claim 1 wherein said clearance between the inner surface of said flange and the flat outer surface of said jack or receptacle surrounding said opening does not exceed about 0.06 inch.

3. A kit for preventing unauthorized access to a first telephone or computer line, said kit comprising a modular connector having a solid body portion, connected to a second telephone or computer line, said solid body portion comprising a contacting terminal portion exposed in its base constructed to mate with a standard jack or receptacle connected to said first telephone or computer line wherein said jack or receptacle connected to said first telephone or computer line has bare connecting wires exposed on its lower surface and a flat outer face with an opening constructed to receive said modular connector so that the exposed terminal portion of said modular connector is in snug electrically-engaged relation with the bare connecting wires of said jack or receptacle, and said opening has an internal stop projecting from an inner wall thereof;

a spring-biased tab disposed in cantilever fashion on the upper surface of said solid body portion, said tab having a shoulder constructed, when said connector is in snug electrically-engaged relation with the opening of said jack, to bear against said internal stop, said tab having no portion which protrudes beyond the face of said opening in said snug electrically-engaged relation of said connector and said jack, and wherein the outer end of said modular connector comprises a flange extended in a plane substantially normal to the principal axis of said modular connector, constructed to form a clearance with the inner surface of said flange in substantially parallel close proximity to the flat outer face of said jack or receptacle surrounding said opening when said modular connector is in snug electrically-engaged relation with said jack or receptacle, thereby preventing manual removal of said modular connector from said jack or receptacle;

a tool for removing said modular connector from said jack or receptacle which comprises an elongated L-shaped body having a principal shaft with a coaxially disposed handle at one end, and a rectangular bend at the other end, providing a projecting terminal having a beveled tip constructed to fit in the clearance between said flange and the face of said jack or receptacle surrounding said opening and to enter said opening and to depress said tap to release the shoulder of said tab from said stop.

4. The combination in accordance with claim 3 wherein said jack or receptacle is connected to said first telephone or computer line by means of a conventional screw, and said kit includes a "tighten only" screw, constructed to be substituted for said conventional screw for securing said standard jack or receptacle to said first telephone or computer line.

5. The method of preventing unauthorized access to a first telephone or computer line connected through a standard jack or receptacle having a flat outer face with a substantially rectangular opening constructed to accommodate in snug electrically-engaged relation a modular connector comprising a solid body portion exposing on its lower surface the bare connecting wires of a terminal leading from a second telephone or computer line, wherein said substantially rectangular opening has an internally projecting stop, and bare connecting wires on its internal lower surface, and said modular connnector has a spring-biased tab disposed in cantilever fashion on the upper surface of said body to bear against said stop projecting from an internal surface of the opening of said jack or receptacle when said connector is in snug electrically-engaged relation with said jack or receptacle so that said bare connecting wires on said solid body portion engage the bare connecting wires on the bottom of said opening; wherein a spring-biased tab disposed on the upper surface of said modular connector being provided with a shortened end portion so that when said connector is in closed engagement with said jack or receptacle no portion of said tab protrudes beyond the face of the jack or receptacle surrounding said opening;

providing the outer end of said modular connector with a flange which is constructed when said modular connector is in snug electrically-engaged relation with said jack or receptacle to form between the flat outer surface of said jack or receptacle surrounding said opening and the inner surface of said flange, a manually inaccessible clearance thereby preventing manual removal of said modular connector from said jack or receptacle.

6. The method in accordance with claim 5 which comprises interposing an L-shaped special access tool having a normally projecting beveled tip between the flange of said modular connector and the flat face of said hack or receptacle having a thickness less than the dimension of said clearance for gaining access to said opening, and utilizing the projecting tip of said tool to depress said tab, releasing said modular connector from engagement with said jack or receptacle.

7. The method in accordance with claim 5 wherein said jack or receptacle is connected to said first telephone or computer line with a conventional screw, the step of replacing said conventional screw with a "tighten only" screw for securing said jack or receptacle to said first telephone or computer line.

* * * * *

UNITED STATES PATENT AND TRADEMARK OFFICE

CERTIFICATE OF CORRECTION

PATENT NO. : 4,615,575

DATED : October 7, 1986

INVENTOR(S) : Michael G. Kossor

It is certified that error appears in the above-identified patent and that said Letters Patent are hereby corrected as shown below:

In the Abstract, line 14, change "denyed" to ---denied---.

Column 1, line 40, after "removed", delete remainder of line.

Column 1, line 41, before "by" delete entire line.

Signed and Sealed this

Third Day of March, 1987

*Attest:*

DONALD J. QUIGG

*Attesting Officer*

*Commissioner of Patents and Trademarks*